United States Patent [19]

Arnold

[11] 4,023,659

[45] May 17, 1977

[54] DUAL VOLTAGE ELECTRO-MECHANICAL CLUTCH BRAKE CONTROL SYSTEM

[75] Inventor: Bruce Edward Arnold, Clinton, N.J.

[73] Assignee: The Singer Company, New York, N.Y.

[22] Filed: Oct. 3, 1975

[21] Appl. No.: 619,435

[52] U.S. Cl. ..... 192/12 D; 192/84 R; 188/163; 361/187

[51] Int. Cl.² ..... F16D 67/06

[58] Field of Search ..... 192/12 D, 17 C, 18 B, 192/84 R; 317/148.5 R; 310/100

[56] References Cited

UNITED STATES PATENTS

| | | | |
|---|---|---|---|
| 3,241,002 | 3/1966 | Smith | 192/84 R |
| 3,268,045 | 8/1966 | Poumakis | 192/84 R |
| 3,516,526 | 6/1970 | Seesselberg | 192/12 D |
| 3,558,997 | 1/1971 | Derc | 317/148.5 R |
| 3,660,730 | 5/1972 | Mason | 317/148.5 R |

*Primary Examiner*—Benjamin W. Wyche
*Attorney, Agent, or Firm*—Edward L. Bell; Robert E. Smith; Julian Falk

[57] ABSTRACT

A control system is disclosed for providing a dual voltage electrical power supply for a variable load such as an electro-mechanical clutch-brake power transmitter of the type used for instance for a loom transmitter. A control arrangement is disclosed in which high voltage is continuously available under control of low voltage timing and drive circuits.

5 Claims, 4 Drawing Figures

13
48
116
117
118
86
85
84
11
87
82
83
81
80
61
60
115
114
113
112
111
110
102
103
101
100
62
63
66
65
64
67
68
69
70
71
72
79
90
78
76
77
74
75
73
91
92
46
56
47
57
36
37
26
27
25
20
21
22

12
85'
118'
117'
116'
84'
87'
14
60'
61'
48
82'
83'
81'
80'
115'
114'
113'
62'
63'
66'
65'
64'
79'
90'
76'
78'
112'
111'
67'
68'
69'
77'
102'
110'
103'
70'
71'
74'
73'
130
101'
100'
91'
92'
72'
40
57
47
48
58
49
59
38
39
28
29
25

Fig. 3
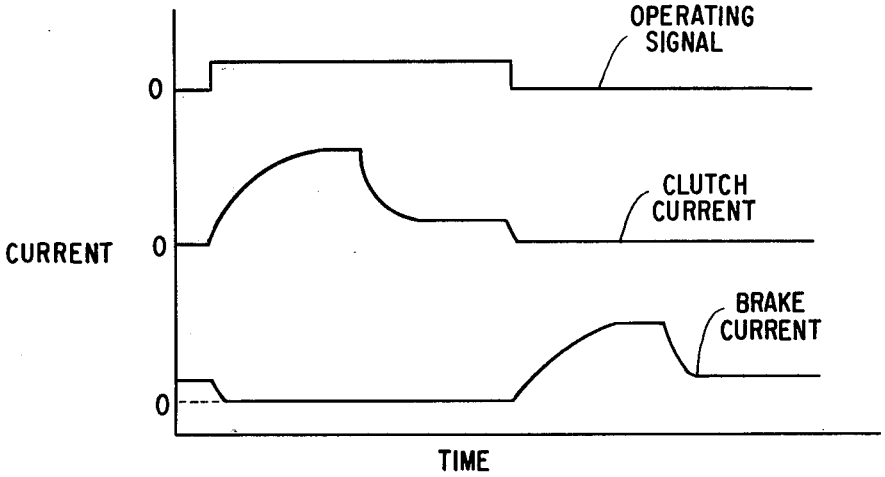
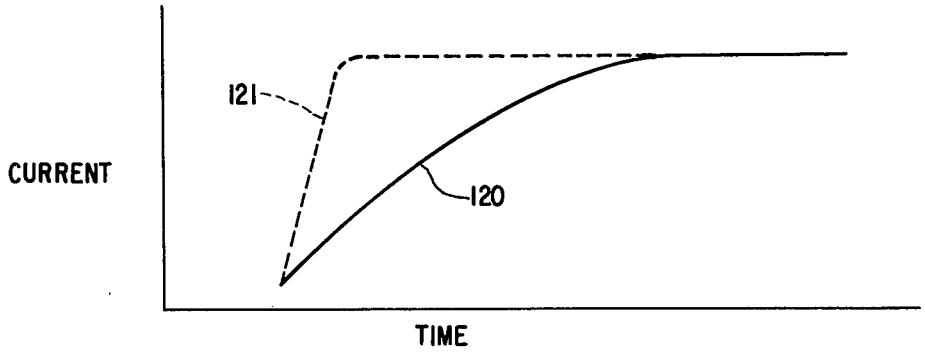
Fig. 4

DUAL VOLTAGE ELECTRO-MECHANICAL CLUTCH BRAKE CONTROL SYSTEM

BACKGROUND OF THE INVENTION

Electro-mechanical clutch-brake power transmitting devices are well known in the prior art for driving machinery such as textile looms and the like. With such power transmitting devices, the flow of power from a motor to the loom is controlled by selective operation of the clutch and the brake. A problem which exists with clutch-brake type power transmitting devices concerns the response time incident to the operation of the clutch and brake. On the one hand taking up of the lost motion or slack in the clutch or brake, can be time consuming. The electrical time constant of the system including the clutch or brake solenoid coils is also a factor influencing the response time of the system.

It has been proposed heretofore to utilize relatively low voltage electrical power to maintain the clutch or brake in an operative condition but to apply intermittently a pulse of high voltage quickly to take up the slack in the clutch or brake actuation. It has been known to provide such intermittent high voltage pulses by use of a capacitive discharge system, however, the time required to recharge the capacitor after each use has limited such known systems to applications having slow rates of on-off cycling.

One type of loom operation for which the prior art capacitive discharge systems have not been adequate involves the "jogging" mode of loom operation in which the loom is repeatedly started and stopped to provide a relatively slow operation useful in diagnosing malfunction, correcting yarn breakage or the like.

SUMMARY OF THE INVENTION

It is an object of this invention to provide a dual voltage power supply system in which in addition to a continuous supply of low voltage power, predetermined periods of high voltage power are always immediately available. This object is attained by eliminating all requirements for energy storage in the power supply system by providing for transistorized control of current flow directly from a high voltage power supply.

Another object of this invention is to provide a low cost dual voltage power supply system employing a preponderance of economical low voltage timing and control components. This object is attained by an arrangement separating and isolating all timing and control components except one high voltage transistor from each high voltage circuit in the system so that the remaining components in the system are subjected only to the influence of low voltage potential.

DESCRIPTION OF THE DRAWINGS

A preferred form of this invention is illustrated in the accompanying drawings in which:

FIG. 3 is a graph showing a set of curves coordinating the application to the control circuit of FIGS. 1 and 2 of control signals initiating and terminating loom operation with the typical current flow to the clutch and brake solenoid coils, and FIG. 4 is a graph comparing the typical current flow pattern to one of the solenoid coils in response to low voltage power supply as compared with high voltage power supply.

DESCRIPTION OF THE PREFERRED EMBODIMENT

The dual voltage power supply control of this invention is adapted for influencing the electro-magnetic clutch brake solenoid coils of a power transmitter of the type which is disclosed in the U.S. Pat. No. 2,860,748, dated Nov. 18, 1958 of E.P. Turner, et al. which is incorporated herein by reference.

Figure 1:
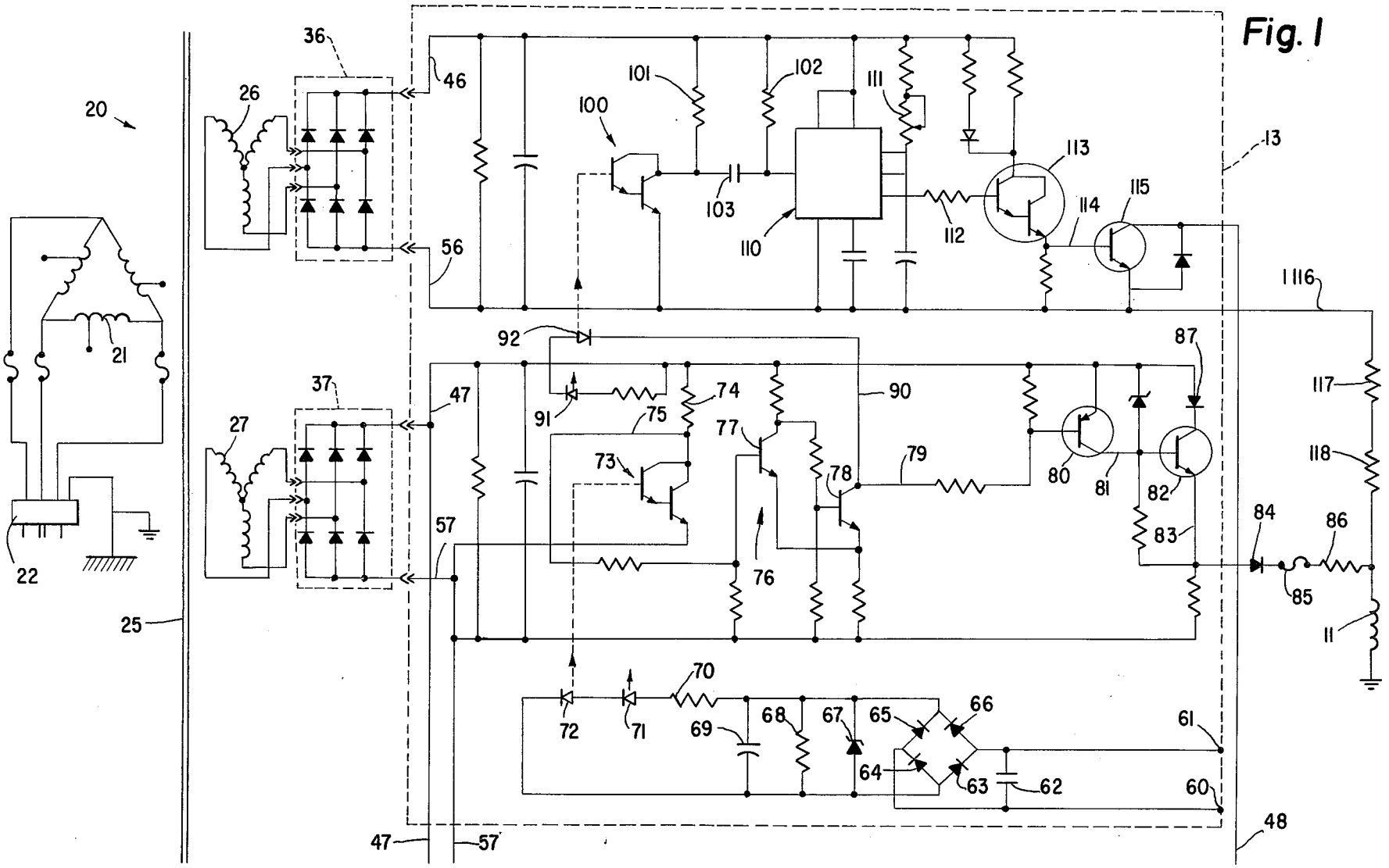
FIG. 1 is a schematic wiring diagram showing that portion of a control circuit embodying the features of this invention for influencing the clutch operating solenoid coil of a loom power transmitter.
Figure 2:
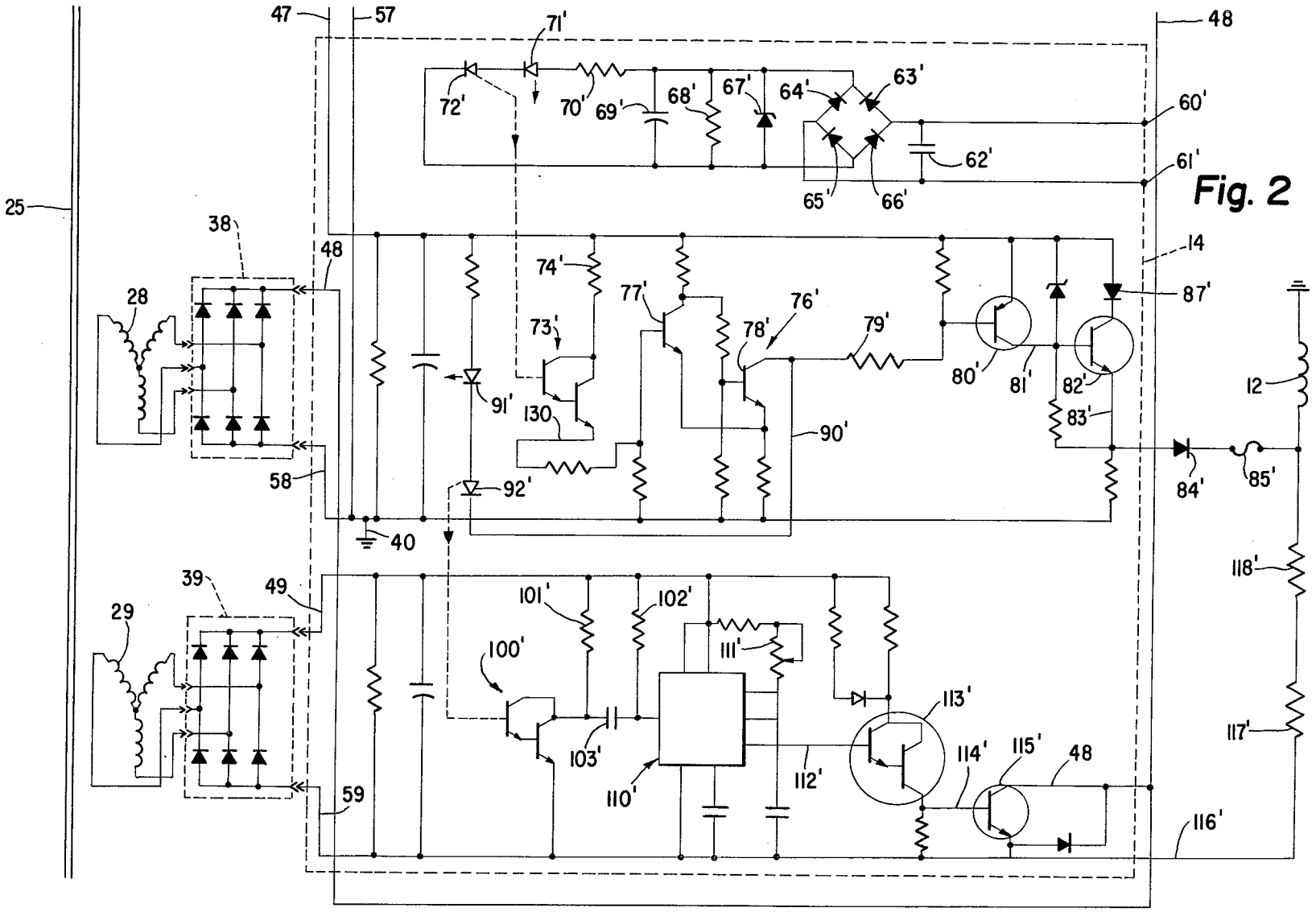
FIG. 2 is a schematic wiring diagram showing that portion of a control circuit for influencing the brake operating solenoid coil of the loom power transmitter.

In the accompanying drawings FIGS. 1 and 2 each illustrate a portion of the control circuit of this invention and may best be considered together. In FIG. 1, the solenoid coil 11 of the clutch is illustrated while in FIG. 2, the solenoid coil 12 for the brake is shown and in general FIG. 1 illustrates those components of the control circuit which pertain to control of the clutch solenoid coil while FIG. 2 illustrates those components concerned with control of the brake solenoid coil.

As shown in FIG. 1, the components concerned with control of the clutch solenoid coil may be mounted on a panel 13 and as shown in FIG. 2 the components concerned with operation of the brake solenoid coil may be mounted on a panel 14. The components on each of the panels 13 and 14 are quite similar, and moreover, these components operate in a similar fashion. The following description, therefore, will pertain to the elements on the clutch control panel 13 and these will be described in detail. Those elements on the brake control panel 14 which are identical to their counterpart on the clutch control panel will be given the same reference character designation except that the components in the brake panel will be designated by prime numbers and a detailed description will be given of only the differences between the brake and clutch panel arrangements.

Illustrated at the left hand side of FIGS. 1 and 2 is a power transformer indicated generally at 20 and including three-phase AC primary windings 21 supplied from a power source (not shown) by way of a power switch 22. Indicated at 25 is a transformer core, it being understood that the primary windings 21 supply the secondary transformer coils of both FIGS. 1 and 2. Four separate secondary three-phase transformer windings are provided as indicated at 26, 27, 28 and 29 in FIGS. 1 and 2. With each of the transformer secondary windings 26, 27, 28 and 29 is associated a three-phase full wave diode bridge 36, 37, 38 and 39 respectively. The output of each of the full wave bridges 36 - 39 will be a substantially pure DC supply which may be, of course, tailored as to voltage but which preferably can be arranged to provide either a low voltage on the order of 10 volts DC or a high voltage on the order of 100 volts DC. Preferably, the bridges 36, 37, and 39 output low voltages while bridge 38 outputs a high voltage.

It will be noted that from the bridge 36 a high potential line 46 extends on the clutch panel 13 as does a low potential or return line 56. From the transformer bridge 37 a high potential line 47 extends on the clutch panel 13 shown in FIG. 1 and, also this line also extends the brake panel 14 as shown in FIG. 2 as does a low potential or return line 57. From the transformer bridge 38 a high potential line 48 is similarly associated with both the clutch panel 13 and the brake panel 14 and the low potential or return line 58 extends on the brake panel 14. Extending from the transformer bridge 39 is a high potential line 49 as well as a low potential or return line 59. It will be noted that the return line 56 for the bridge 36, and the return line 59 for the bridge 39 are not electrically grounded. However, the return lines 57 for the transformer bridge 37 and the return line 58 for the transformer bridge 38 are connected to a common electrical ground 40.

Referring now to FIG. 1 the components on the clutch panel 13 will now be described and a description will be provided of the operation of the clutch solenoid coil 11. As shown at 60 and 61, in FIG. 1 are input terminals on the clutch panel 13 adapted to accept a power transmitting operating signal. This signal may be a AC voltage preferably on the order of 24 volts and may be operator influenced by closure of a conventional starting switch for the purpose of initiating transmission of power to a loom or other textile equipment. The signal is received across a capacitor 62 and rectified by a diode bridge 63, 64, 65 and 66. The signal is then filtered and clipped by a Zener diode 67 a resistor 68 and a capacitor 69 and applied through a current limiting resistor 70 to two light emitting diodes 71 and 72. LED 71 serves as an indicator to the machine operator that a signal has been applied to the clutch panel, while the LED 72 is the light emitting diode half of a photoconductor assembly indicated generally at 73, which preferably consists of a high gain Darlington phototransistor which as shown in FIG. 1, is connected across the circuit 47, 57 of the low voltage transformer bridge 37 in series with a resistor 74. By use of the photoconductor assembly 73, the components in the circuit 60, 61 which accepts the power transmitter operating signals are electrically isolated from the other circuits of the system. This approach minimizes noise and ground loop problems when interfacing this system with other control systems.

When the phototransistor assembly conducts in response to light delivered from the LED 72, it provides a near zero input voltage by way of a line 75 to a Schmidt trigger circuit 76 which includes the transistors 77 and 78. The output of the Schmidt trigger circuit on line 79 then goes low which turns on the amplifier transistor 80 which supplies a drive current in the line 81 to the low voltage power transistor 82. When driven, the low voltage power transistor 82 will conduct by way of the line 83 through an isolation diode 84, fuse 85, and a resistor 86 to the clutch solenoid coil 11. A diode 87 may be placed in series with the low voltage power transistor 82 to limit the voltage drop across the power transistor thus minimizing the heating losses while the power transistor is on.

The circuit thus far described serves to apply low voltage power to the clutch solenoid coil 11 in response to a power transmitter operating signal applied across the terminals 60, 61 and this low voltage power will be applied continuously to the solenoid coil as long as operation of the transmitter is called for by the signal.

At the same time that the Schmidt trigger circuit 76 caused the output on line 79 to go low, flow of current is induced in a line 90 causing operation of light emitting diode 91 and light emitting diode 92. The LED 91 serves as an indication to the machine operator that a signal has been applied in the line 90, while the LED 92 is the light emitting diode half of a photoconductor assembly indicated generally at 100 which preferably consists of a high gain Darlington phototransistor, which as shown in FIG. 1, is connected across the circuits 46, 56 of the low voltage transformer bridge 36 in series with a resistor 101. When the LED 92 is operated, this causes the photoconductor assembly 100 to conduct thus providing a falling signal at resistor 101, which is differentiated by the resistor 102 and capacitor 103 and is used to trigger an electronic timing assembly 110. A Motorola, Inc. MC 1555 monolithic timing circuit may be used to provide the timing assembly 110. By suitable adjustment of the variable resistor 111, the electronic timing assembly 110 is caused to provide in the line 112 a current flow of predetermined time duration to turn on the amplifying transistor 113. The output of the amplifier transistor 113 produces a drive current pulse in the line 114 connected to the base of the high voltage power transistor 115. The circuit and all of the components thus far described are subjected to the low voltage supply from either the diode bridge 36 or 37 and thus all of the components thus far described may be of low cost, low voltage capacity. When the high voltage power transistor 115 is turned on, however, it will conduct current from the high potential, high voltage line 48 to the low potential or ground line 56 of the low voltage diode bridge 36. A line 116 is connected from the return line 56 through suitable resistors 117, 118 to the clutch solenoid coil 11 so that while the high voltage power transistor 115 conducts, a high voltage, preferably on the order of 100 volts DC, will be applied to the clutch solenoid coil 11 for the duration of the predetermined time metered by the timing assembly 110. The high voltage pulse applied to the solenoid coil 11 will not only cause more rapid engagement of the clutch by virtue of the high force applied thereto and a consequent reduction of the maximum inertia effect, but also the use of the high voltage pulse results in the relatively small electrical time constant (L/R) which is beneficial for rapid clutch engagement. FIG. 4 illustrates a comparison of the time required for the current to rise clutch coil 11, the solid line 120 on the graph indicating the response to low voltage current and the dotted line curve 121 indicating the response to the high voltage current. Preferably, the timing assembly 110 is adjusted to provide only for that duration of pulses which will effect the desired rapidity of solenoid coil operation which is required.

Referring now to FIG. 2 which discloses the circuit panel and 14 for the components which control the brake solenoid coil 12, it will be observed that substantially identical components are provided as in the circuit panel 13 for controlling the clutch solenoid coil 11.

It will be observed, however, that as the circuit panel 14, the photoconductor assembly 73′ is arranged differently in that an output line 130 from the opposite side of the photoconductor assembly 73′ than that on which the resistor 74′ is connected provides the input control to the Schmidt trigger circuit 76′. As a result, the output of the Schmidt trigger circuit on line 79′ will be the opposite of that in the clutch control circuit, panel 13. The line 130 will be at near zero potential when the photoconductor assembly 73′ is dormant and when the photoconductor 73′ conducts in response to light from the LED 72′, the potential in the line 130 will rise. It is by this arrangement that the brake solenoid coil 12 will be deactivated when the clutch solenoid coil is energized and vice-versa.

Referring to FIG. 3, wherein the ordinant indicates current flow and the abscissa indicates time, the curve represents the operating signal as applied to the input terminals 60, 61 and 60′, 61′. The middle curve represents the clutch current and indicates the rapid high current flow obtained after receipt of an operating signal. The lowest curve shows the brake current and indicates the rapid high current flow which results when the operating signal is discontinued.

Referring again to FIGS. 1 and 2, it will be appreciated that during the time interval as determined by the timing assembly 110, high voltage power is applied via line 116 to the clutch solenoid coil 11, the potential of the return line 56 will similarly rise to the high voltage potential above ground. The diode bridge 36 during such periods will automatically regulate the level of potential in the high potential line 46 to be only that increment above the potential in the return line 56 which is equal to the low voltage potential, preferably on the order of 10 volts DC.

Similarly the potential in the return line 59 will rise to the high voltage potential during the time intervals determined by the timing assembly 110′ when the brake solenoid is subjected to high voltage. The diode bridge 39 will automatically limit the potential across the lines 49, 59 to that of the low voltage, approximately 10 volts DC.

In the circuit of the present invention, high voltage is always available without any delay necessitated by the need for energy storage as in prior known capacitive circuits and, therefore, jogging of textile machinery 5 to 10 times per second can be provided with no sacrifice in performance.

Having set forth the nature of this invention, what is claimed herein is:

1. A dual voltage power supply control for at least one of the solenoid coils of an electro-magnetic clutch brake regulated power transmitter comprising; means for providing separate high and low DC voltage power supplies, a low voltage power transistor arranged in a low voltage control circuit with said low DC voltage power supply for influencing a low voltage output to said solenoid coil, means for selectively applying a transmitter operating signal to said power supply control, means effective during application of said operating signal for influencing said low voltage control circuit to apply a continuous drive current to said low voltage power transistor, a high voltage power transistor arranged in a high voltage control circuit with said high DC voltage power supply for influencing a high voltage output to said solenoid coil, and means effective in response to each application of said power transmitter operating signal for initiating a drive current pulse of predetermined time duration to said high voltage power transistor, said drive current pulse applied to the high voltage power transistor being generated by an electronic timing assembly which is subjected only to the electrical potential imposed by said low voltage power supply.

2. A dual voltage power supply control as set forth in claim 1 in which said means for providing separate high and low DC voltage power supplies comprises a transformer including a three phase AC primary winding and separate three phase secondary windings each connected electrically with a three phase full wave diode bridge.

3. A dual voltage power supply control as set forth in claim 2 in which certain of the low voltage power supplies are arranged to control the application of energy from the high voltage power supply, in which the return line of the high voltage power supply is connected to ground but the return line of said certain low voltage power supplies is not, in which the high voltage potential is applied to the return line of said certain low voltage power supplies, while the drive current pulse is applied to the high voltage power transistor, and in which the full wave diode bridge associated with the low voltage secondary winding of the power transformer serves automatically to maintain the low voltage potential across said certain low voltage power supplies despite changes in the level of potential relation to ground in the low voltage return line.

4. A dual voltage power supply control as set forth in claim 3 in which the means for influencing said certain low voltage power supplies to apply drive currents to said high and low voltage power transistors includes a photo-coupled photo-transistor which optically isolates components in the circuit from the influence of changes in the level of potential relative to ground in the low voltage return line.

5. A dual voltage power supply control as set forth in claim 2 in which separate controls are provided for the clutch solenoid coil and for the brake solenoid coil of said electro-magnetic clutch brake power transmitter, and in which operating voltage including a high voltage supply for a limited time period is supplied to the solenoid coil of the clutch whenever a transmitter operating signal is applied and to the solenoid coil of the brake when the transmitter operating signal is discontinued.

* * * * *